US009136648B2

(12) United States Patent
Molnar

(10) Patent No.: US 9,136,648 B2
(45) Date of Patent: Sep. 15, 2015

(54) DIN OR PANEL GROUND INTEGRAL TO CONNECTOR BODY

(71) Applicant: Nathan J. Molnar, Shaker Heights, OH (US)

(72) Inventor: Nathan J. Molnar, Shaker Heights, OH (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 65 days.

(21) Appl. No.: 13/939,525

(22) Filed: Jul. 11, 2013

(65) Prior Publication Data

US 2014/0017917 A1 Jan. 16, 2014

Related U.S. Application Data

(60) Provisional application No. 61/670,976, filed on Jul. 12, 2012.

(51) Int. Cl.

| | |
|---|---|
| ***H01R 13/648*** | (2006.01) |
| ***H01R 43/18*** | (2006.01) |
| ***H01R 9/26*** | (2006.01) |
| *H01R 13/66* | (2006.01) |

(52) U.S. Cl.

CPC ..... *H01R 13/648* (2013.01); *H01R 9/2675* (2013.01); *H01R 9/2691* (2013.01); *H01R 43/18* (2013.01); *H01R 13/6675* (2013.01); *Y10T 29/49149* (2015.01)

(58) Field of Classification Search

USPC ..... 439/108, 76.1, 94, 95, 716; 248/694

See application file for complete search history.

(56) References Cited

U.S. PATENT DOCUMENTS

| | | | | |
|---|---|---|---|---|
| 4,269,471 | A * | 5/1981 | Woertz | 439/94 |
| 5,480,310 | A * | 1/1996 | Baum | 439/94 |
| 5,594,199 | A * | 1/1997 | Ciaccio | 174/382 |
| 5,641,313 | A * | 6/1997 | Hohorst | 439/709 |
| 5,797,756 | A * | 8/1998 | Nad | 439/94 |
| 5,928,008 | A * | 7/1999 | Munshi | 439/94 |

(Continued)

FOREIGN PATENT DOCUMENTS

| | | |
|---|---|---|
| DE | 43 03 717 | 8/1994 |
| DE | 44 02 001 | 7/1995 |
| DE | 10 2008 041 726 | 3/2010 |

OTHER PUBLICATIONS

Partial European Search Report dated Jan. 31, 2014 for Application No. EP 13 17 6385.

*Primary Examiner* — Alexander Gilman

(74) *Attorney, Agent, or Firm* — Fay Sharpe LLP

(57) ABSTRACT

An electronics module housing includes an external recess adapted to receive an associated DIN rail or other associated mounting structure. A latch mechanism is associated with the external recess and is adapted to engage the DIN rail. An electronics circuit board is located in the housing. An electrical connector is physically and electrically connected to the circuit board. The electrical connector includes: (i) a connector body; (ii) a plurality of electrical contacts secured to said connector body and comprising contact pins physically and electrically connected to the circuit board; and (iii) a ground contact secured to the connector body and including a ground pin physically and electrically connected to said circuit board. The ground contact includes a ground contact body that extends from the connector body into the housing recess. The ground contact body includes a ground contact face located adjacent the recess and adapted to contact the associated DIN rail to which the module is mounted.

15 Claims, 6 Drawing Sheets

(56) References Cited

U.S. PATENT DOCUMENTS

| | | | | |
|---|---|---|---|---|
| 5,978,193 | A * | 11/1999 | Kaaden | 361/64 |
| 6,371,435 | B1 * | 4/2002 | Landis et al. | 248/694 |
| 6,425,770 | B1 * | 7/2002 | Lostoski et al. | 439/76.1 |
| 6,431,909 | B1 * | 8/2002 | Nolden et al. | 439/532 |
| 6,456,495 | B1 * | 9/2002 | Wieloch et al. | 361/729 |
| 6,575,771 | B2 * | 6/2003 | Schnatwinkel et al. | 439/76.1 |
| 6,840,819 | B2 * | 1/2005 | Bet et al. | 439/716 |
| 7,575,484 | B2 * | 8/2009 | Van Der Mee et al. | 439/716 |
| 7,686,627 | B2 * | 3/2010 | Wu et al. | 439/95 |
| 7,922,521 | B1 * | 4/2011 | Wu | 439/532 |
| 8,727,797 | B2 * | 5/2014 | Parrish et al. | 439/94 |
| 2002/0072256 | A1 * | 6/2002 | Lostoski et al. | 439/76.1 |
| 2012/0220144 | A1 * | 8/2012 | Parrish et al. | 439/94 |

* cited by examiner

DIN OR PANEL GROUND INTEGRAL TO CONNECTOR BODY

CROSS-REFERENCE TO RELATED APPLICATION

This application claims priority from and benefit of the filing date of U.S. provisional application Ser. No. 61/670,976 filed Jul. 12, 2012, and the entire disclosure of said provisional application is hereby expressly incorporated by reference into the present specification.

BACKGROUND

Modules for housing electronic components are often used for industrial automation controllers, industrial automation input/output (I/O) modules, and related applications. These electronics modules are commonly connected to a DIN rail or other mounting structure, and the electronic printed circuit board(s) (PCB) contained in the module are electrically grounded through the DIN rail when the module is physically connected to the DIN rail. It is critical to establish a reliable and durable low impedance ground path from the module PCB to the DIN rail.

Known ground connectors for this purpose have been found to be suboptimal. In one prior arrangement, a pressure (non-soldered) contact is used to connect the module's PCB electrically to the ground connector. The ground connector includes clips, pads, and/or other features that abut with an electrical contact of the PCB. In another embodiment, an individual ground contact is soldered to a separate connector board or other intermediate circuit component, but a pressure (non-soldered) connection is still used at the interface between this intermediate circuit component and the PCB inside the module. In either case, these non-soldered, pressure contacts between the PCB and the ground connector (or between the PCB and the intermediate circuit component including the ground connector) increase ground path impedance and are subject to contamination, vibration, and physical damage during assembly and/or repair or maintenance. Use of intermediate circuit boards between the PCB and the DIN rail or other mounting structure increases component and assembly cost and assembly time and can increase impedance in the ground path due to an increased number of non-soldered connections. Other known modules use a separate ground connector that is individually placed and soldered to the PCB, but such a solution requires an additional component placement and soldering operation which undesirably results in additional manufacturing steps and also requires a suitable location on the PCB for installation of the separate ground connector which consumes valuable space on the circuit board.

Accordingly, a need has been identified for a new and improved method and structure for providing an electronics modules with a ground connector that exhibits the required low impedance ground path and that also provides increased durability while reducing manufacturing steps and cost.

SUMMARY

In accordance with one aspect of the present development, an electronics module comprises a housing including an external recess adapted to receive an associated DIN rail or other associated mounting structure. A latch mechanism is associated with the external recess and is adapted to engage the associated DIN rail. An electronics circuit board is located in the housing. An electrical connector is physically and electrically connected to the circuit board. The electrical connector includes: (i) a connector body; (ii) a plurality of electrical contacts secured to said connector body and comprising contact pins physically and electrically connected to the circuit board; and (iii) a ground contact secured to the connector body and including a ground pin physically and electrically connected to said circuit board. The ground contact includes a ground contact body that extends from the connector body into the housing recess. The ground contact body includes a ground contact face located adjacent the recess and adapted to contact the associated DIN rail to which the module is mounted.

In accordance with another aspect of the present development, an electrical connector includes a polymeric connector body. A plurality of electrical contacts are secured to the connector body and include respective contact pins that project outwardly relative to said connector body. A ground contact is secured to said the connector body and includes a ground pin that projects outwardly relative to the connector body. The contact pins and the ground pin are adapted for being soldered to an associated circuit board.

In accordance with a further aspect of the present development, a method for installing a ground connector on a circuit board includes providing an electrical connector comprising: (i) a connector body; (ii) a plurality of electrical contacts secured to the connector body and including a plurality of contact pins that project from the connector body; and, (iii) a ground contact secured to the connector body and including a ground pin that projects from the connector body. The method further includes placing the connector body in contact with a circuit board such that the plurality of contact pins and the ground pin are located adjacent the circuit board. The contact pins and the ground pin are soldered to respective electrically conductive locations on the circuit board.

DETAILED DESCRIPTION

Figure 1:
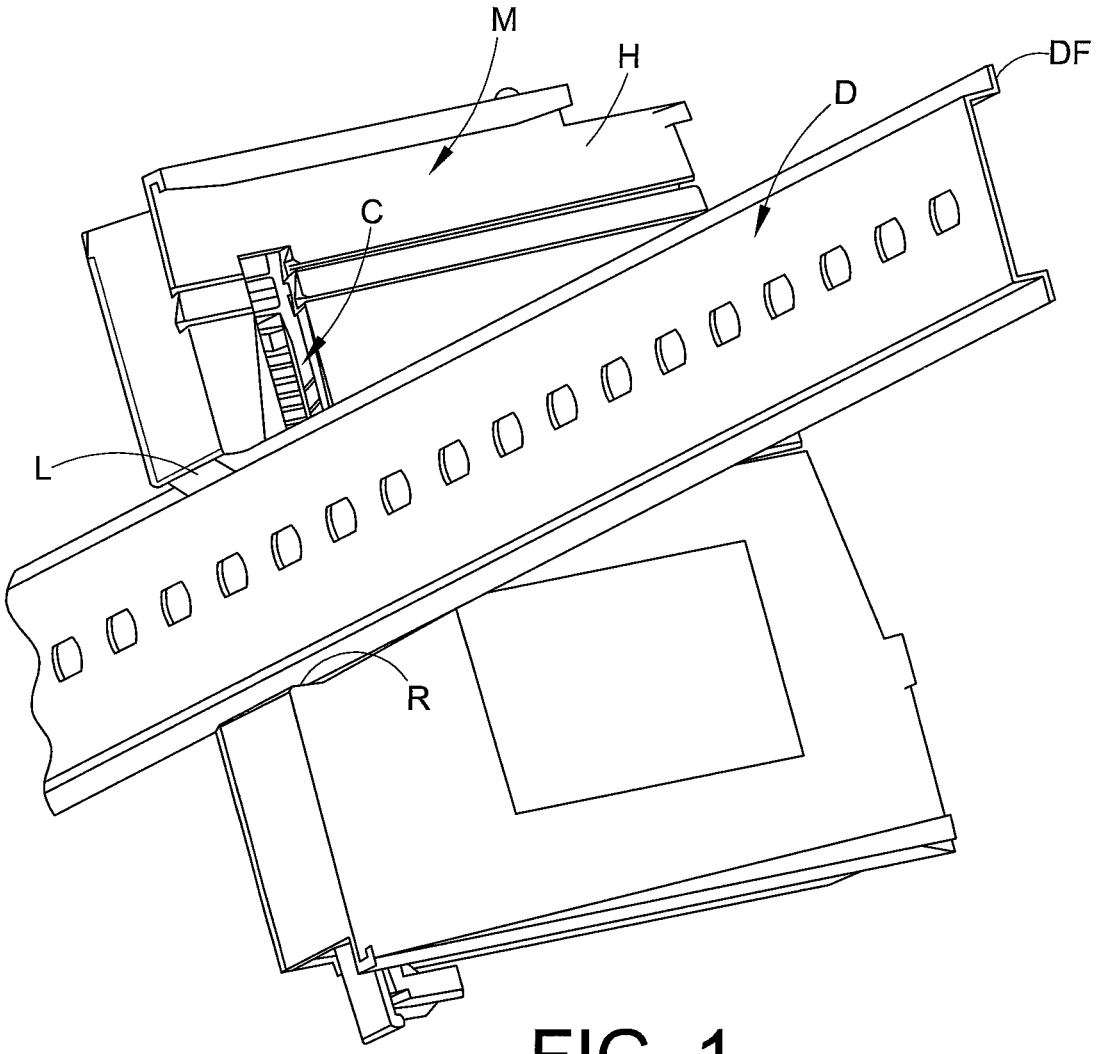
FIG. 1 provides a rear isometric view of an electronics module such as an industrial automation controller module, industrial automation input/output (I/O) module, or the like, engaged with a standard DIN rail that operatively supports the module during use.

FIG. 1 is a rear isometric view that shows an electronics module M, such as an industrial automation controller module, industrial automation input/output (I/O) module, or the like, engaged with a standard DIN rail D that operatively supports the module M when the module is in use. The module M includes a housing H that comprises an external recess R that receives the DIN rail D and also includes a latch mechanism L that operatively engages the DIN rail D and retains the DIN rail in the recess R. The latch L is operable selectively to retain or release the DIN rail D based upon manual operation by a user. The module M can also be adapted to be operably connected to an alternative associated mounting structure, other than the DIN rail D, in which case the recess R and latch L are correspondingly structured and dimensioned to receive and retain the alternative mounting structure.

The module M also includes an electrical connector C that is physically and electrically connected to an electronics circuit board PCB (see also FIG. 3) housed within an internal space defined by the housing H of the module M. The circuit board PCB comprises a plurality of electrical components E connected thereto for providing at least some of the required electronic functionality to the module M. The connector C is used to electrically connect the module circuit board PCB to the circuit board of an adjacent module and/or to another electronic device using a mating connector.

Figure 2:
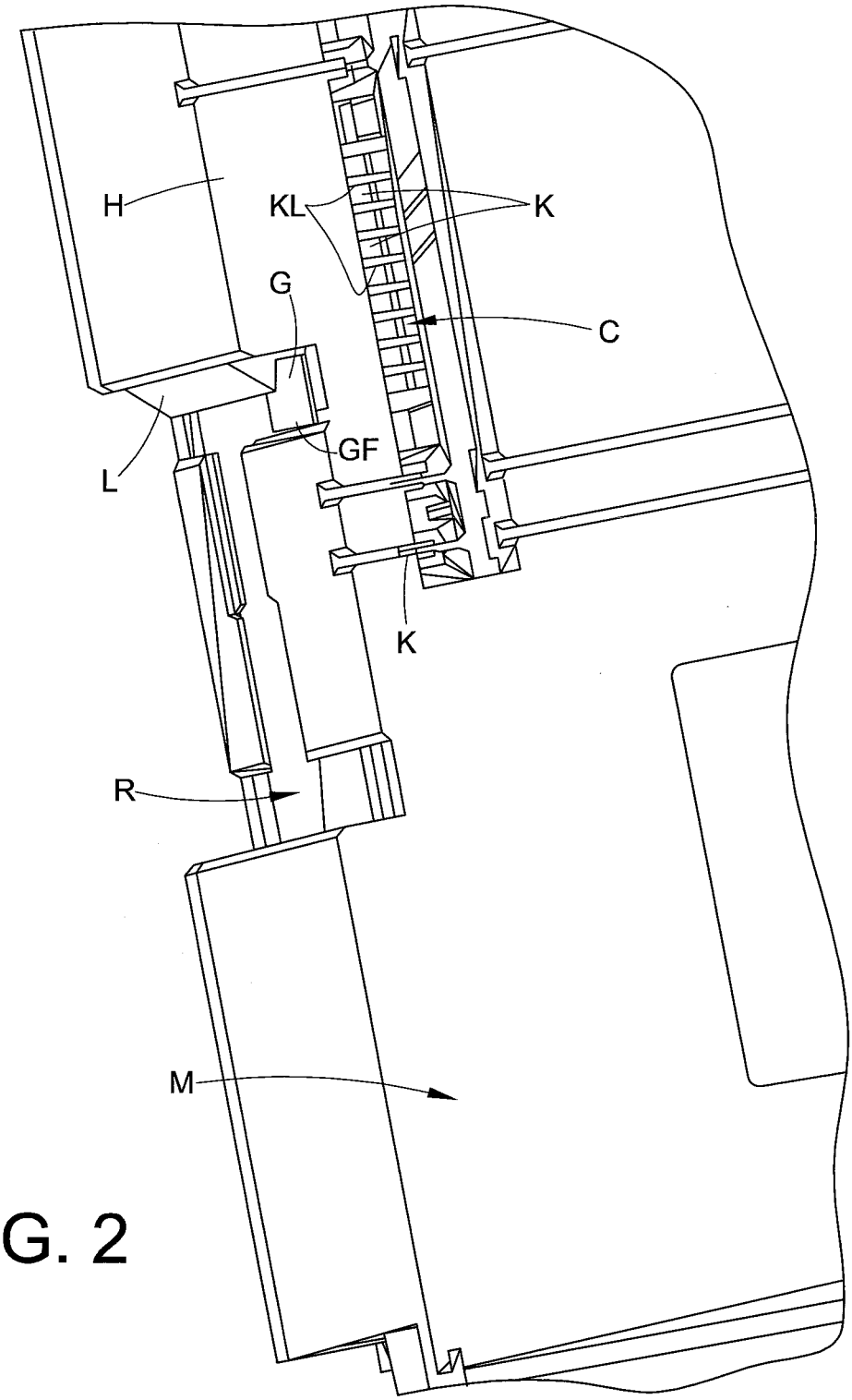
FIG. 2 shows an enlarged portion of the module of FIG. 1, with the DIN rail removed to reveal additional details of the module and ground connector according to the present development.
Figure 3:
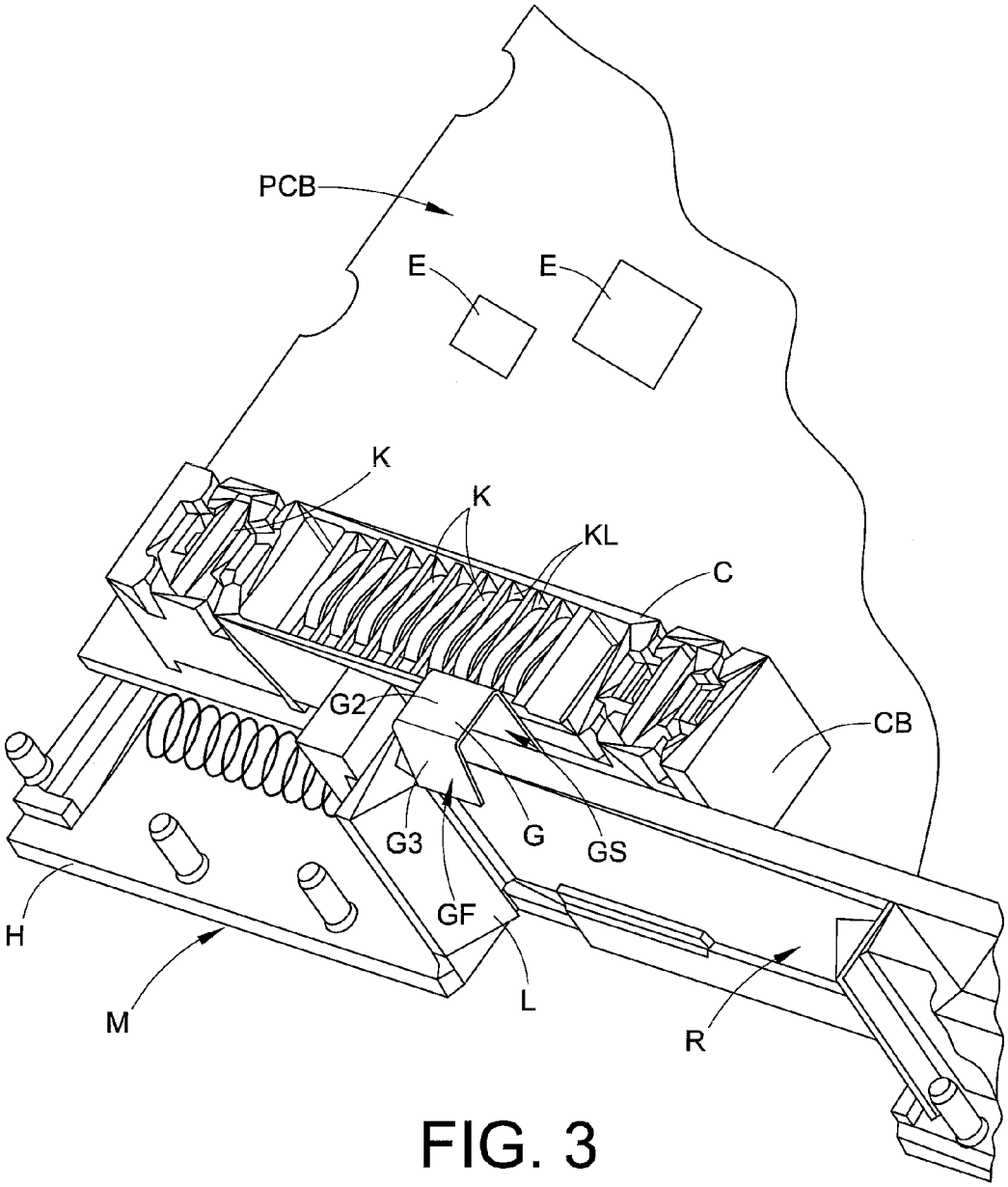
FIG. 3 is similar to FIG. 2 but shows the module M with portions removed to reveal an internal circuit board PCB and an electrical connector including an integral ground connector in accordance with the present development.

FIG. 2 shows an enlarged portion of FIG. 1, with the DIN rail D removed to reveal additional details of the module M. It can be seen in FIG. 2 that the module M includes a metal or other electrically conductive ground contact G comprising a ground contact face GF that is located within or otherwise adjacent the module recess R in order to be positioned to contact the DIN rail D when the DIN rail D is located in the recess R and the module M is operatively connected to the DIN rail. FIG. 3 is similar to FIG. 2 but shows the module M with portions of the housing H removed to reveal an internal circuit board PCB to which the connector C is electrically connected and operatively physically secured. The connector C includes multiple electrical contacts K which can be pins, tabs, sockets, and/or other electrically conductive structures for input and output of electrical signals and/or power between the circuit board PCB and an associated electrical/electronic component(s) operatively mated with the connector C. The connector C comprises a molded polymeric body CB, and the electrical contacts K are frictionally or otherwise secured to the connector body CB in respective contact locations KL. The connector C is shown separately in FIG. 4A where it can be seen that the plurality of contacts K comprise and are connected to respective contact pins KP that project outwardly from the connector body CB and that are electrically and physically connected to the circuit board PCB by soldering or other means.

In contrast to known modules and connectors, the connector C of the module M further comprises the above-noted ground contact G secured to the connector body CB by a friction fit, insert molding, adhesive, mechanical connection and/or other securement means such that the ground contact become an integral part of the connector C along with the electrical contacts K. The ground contact G comprises and is connected to one or more ground pins GP (FIG. 4A) that project outwardly from the connector body CB and that are electrically and physically connected to the circuit board PCB by soldering or other means during the same assembly step when the connector C is operatively secured to the circuit board PCB and when the pins KP of the connector contacts K are soldered or otherwise electrically and physically connected to the circuit board PCB. As used herein, the term "integral" or "integrally" is intended to mean permanently or temporarily connected to the connector body CB such that the ground contact G and connector body CB form a unitary structure during the time that the connector body CB is placed in contact with and physically and electrically connected to the module circuit board PCB.

Figure 4A:
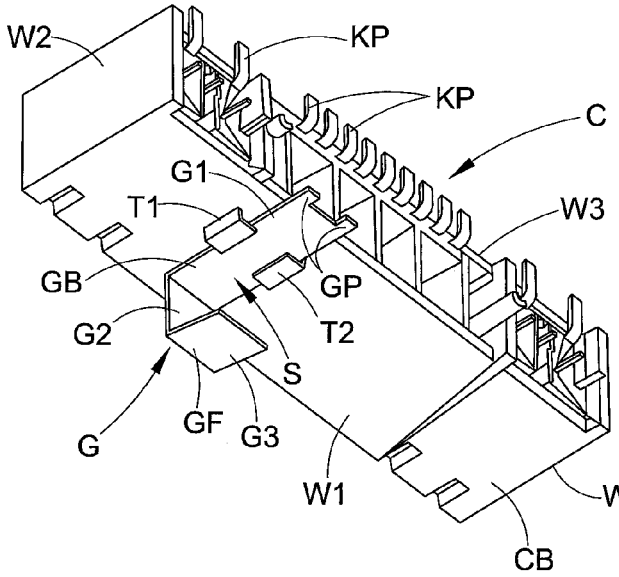
FIG. 4A shows one example of an electrical connector with integral ground contact formed according to the present development, in which the ground contact is integrally connected to the connector body by being mechanically engaged with the connector body so as to form an integral unit therewith.

FIG. 4A shows one example of an electrical connector C with integral ground contact G formed according to the present development. The embodiment of FIG. 4A shows the ground contact G secured to the connector body by being mechanically engaged with the connector body CB so as to form an integral unit with the connector body CB. In particular, the connector body CB comprises outer walls W1, W2, W3,W4, one of which includes a ground contact retaining slot S for receiving and frictionally or otherwise retaining the ground contact G. In the illustrated example, the wall W1 comprises first and second spaced-apart retaining tabs T1,T2 (which can alternatively be connected together at their outer tips) that define the retaining slot S therebetween. The ground contact G comprises a body GB that is slidably received in the slot S and retained therein by friction or the ground contact body GB can be adhesively secured or can be retained by a snap-fit or other suitable connection means.

Figure 4B:
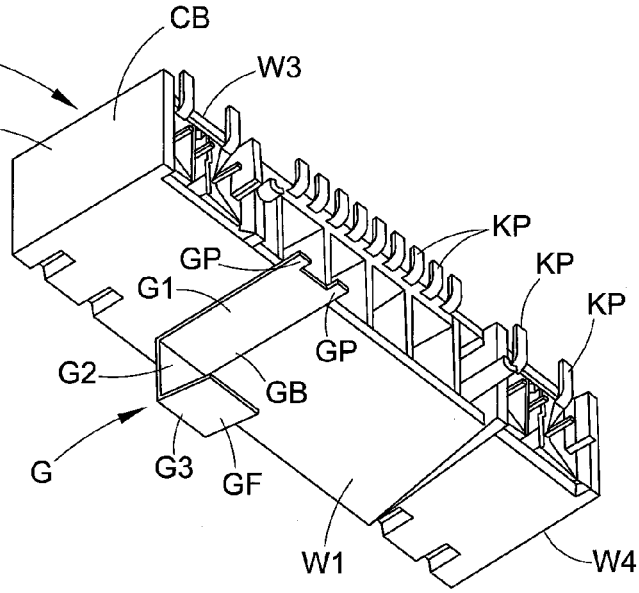
FIG. 4B shows an example of an electrical connector formed in accordance in with an alternative embodiment of the present development, in which the ground contact is integrally connected to the connector body by being adhesively or otherwise externally bonded to the connector body.

FIG. 4B shows an alternative connector embodiment C2 that is identical to the connector C except that the body GB of the ground contact G is secured to the connector body CB by being adhesively or otherwise externally bonded to the wall W1 of the connector body CB so as to form an integral unit therewith.

Figure 4C:
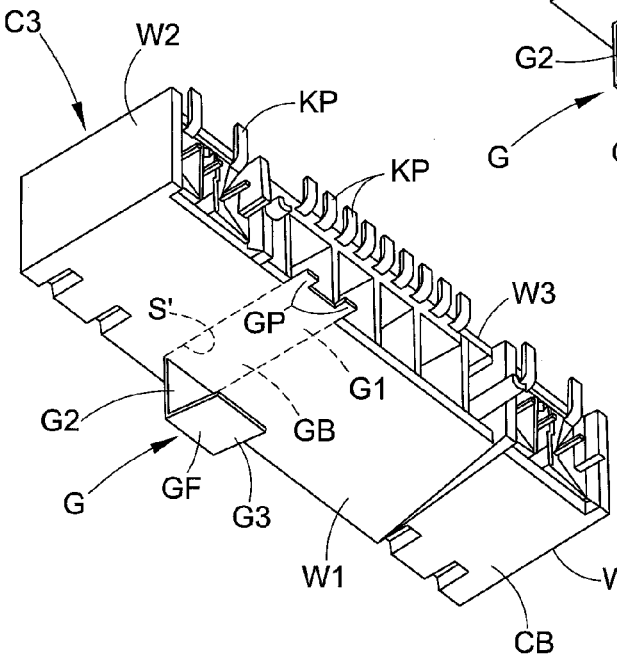
FIG. 4C shows another alternative embodiment of an electrical connector formed in accordance with the present development, wherein the ground contact is insert molded as a part of the polymeric connector body or the ground contact is installed in a slot that is pre-defined in the molded polymeric connector body.

FIG. 4C shows another alternative connector embodiment C3 that is identical to the connector C except that the body GB of the ground contact G is integrally connected to the connector body CB by being insert molded as part of the connector body CB, e.g., within the wall W1 of the body as shown. The connector embodiment C3 can alternatively be formed by including a pre-formed slot S' within the wall W1 when the connector body CB is molded or after the molding operation is completed and by thereafter sliding the ground contact body GB into the slot S'.

Figure 5:
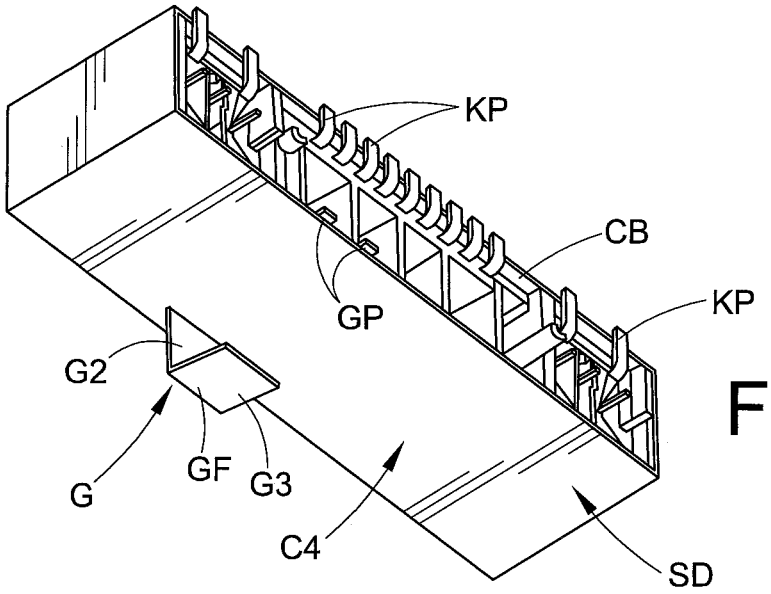
FIG. 5 is an isometric view of an electrical connector formed in accordance with any of FIGS. 4A-4C, wherein the electrical connector further includes a metallic EMI shield or shroud that substantially encases or enshrouds at least four sides of the polymeric connector body.

FIG. 5 is an isometric view of an electrical connector C4 formed in accordance with any of FIGS. 4A-4C, wherein the electrical connector C4 further includes a metallic EMI shield or shroud SD that substantially encases or enshrouds at least four sides W1-W4 of the polymeric connector body CB. The metallic shroud SD shields against electromagnetic interference (EMI) and is electrically connected to the ground contact G such that any EMI conducted to the shroud SD transmitted through the ground contact G to the associated DIN rail ground path or other mounting structure to which the module M is mounted. In an alternative embodiment, the ground contact G can be formed as a one-piece construction as part of the metal shroud SD such that the ground contact is secured to the connector when the shroud SD is installed on the connector body CB. In such case, the ground contact face GF is provided by at least one first extension of the shroud SD while one or more ground pins GP are provided by respective second extensions of the shroud SD. In all cases, the shroud SD defines part of the electrical ground path from the circuit board PCB to the DIN rail D.

Although the connector C is shown with a single ground contact G, it can alternatively comprise two or more ground contacts G that are spaced apart from each other. Also, in the case when a module M includes multiple connectors C, each connector C or only one of the connectors C can include a ground contact G as described herein.

Figure 6:
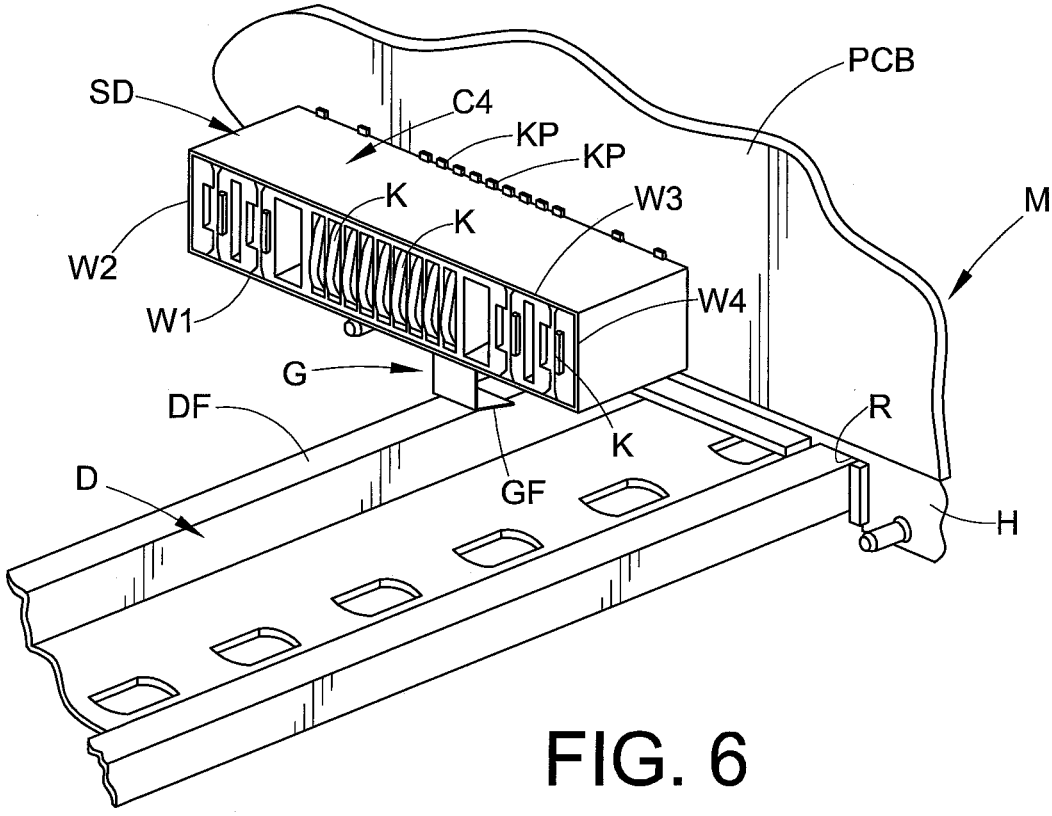
FIG. 6 is a partial isometric view of the electronics module of FIGS. 1 and 2, with portions of the housing removed to reveal internal or hidden components, wherein the electronics modules is operatively engaged with a DIN rail mounting structure.

FIG. 6 shows a module M including a shielded connector C4 formed in accordance with FIG. 5 (although any of the unshielded connectors C,C2,C3 can alternatively be used). The module M is operably mounted on an associated DIN rail D which is located in the recess R. The ground contact face GF of the ground contact G is engaged and abutted with a flange DF of the DIN rail D when the module M is operatively secured to the DIN rail as shown. Because each pin GP of the ground contact G is soldered directly to the circuit board PCB, the ground path between the circuit board PCB and the DIN rail flange DF includes only a single non-soldered pressure interface which is located where the ground contact face GF abuts the DIN rail flange DF. As such, the ground contact G provides a highly effective low impedance ground path between the module circuit board PCB and the DIN rail D.

Figure 7A:
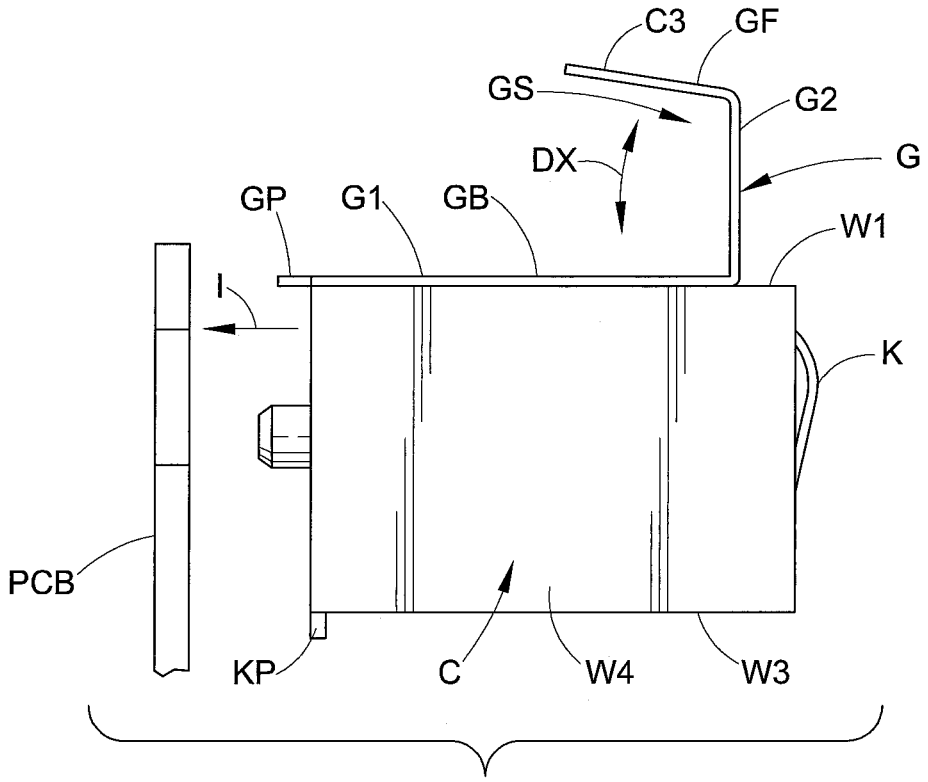
FIG. 7A is an exploded side view that shows an electrical connector with integral ground contact and a circuit board to which the electrical connector is installed in accordance with the present development.
Figure 7B:
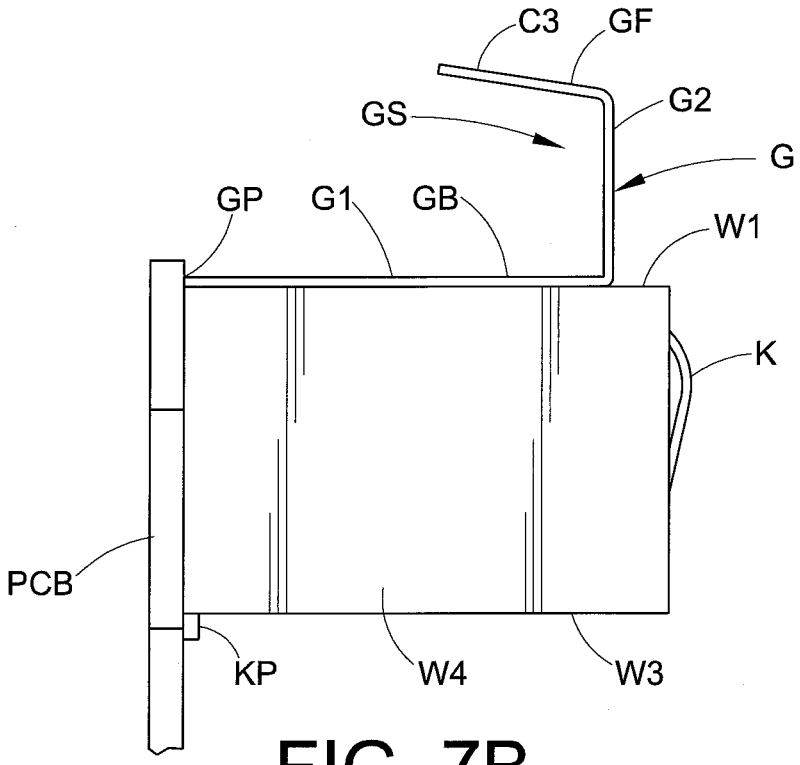
FIG. 7B is a side view corresponding to FIG. 7A, but showing the electrical connector fully installed on the circuit board.

Those of ordinary skill in the art will recognize that including the ground contact G as an integral part of the connector body CB provides for a very efficient assembly process in which the ground contact G is installed on the circuit board PCB as part of the same process in which the connector C is installed on the circuit board PCB. FIGS. 7A and 7B illustrate this assembly process. FIG. 7A shows the circuit board PCB and a connector C (C,C2,C3,C4) including an integral ground contact G formed in accordance with the present development. The connector C is moved in an installation direction I toward the circuit board PCB and/or the circuit board PCB is moved toward the connector C in the opposite direction until the connector C abuts the circuit board PCB as shown in FIG. 7B. Once the connector C is abutted with the circuit board PCB, the contact pins KP and ground pin(s) GP are soldered or otherwise electrically and physically connected to mating electrical contacts of the circuit board PCB to complete the installation of the connector C on the circuit board in a single installation step without requiring separate installation steps for the connector C and ground contact G. No separate ground contact installation step is required to physically or electrically connect the ground contact G to the circuit board PCB, because the ground contact G is physically connected to the connector body CB and the ground contact G is electrically connected to the circuit board PCB as part of the same soldering operation in which the connector contacts K are soldered to the circuit board PCB. Since the connector C must be installed in this manner even if the ground contact G was not included as a part thereof, including the ground contact G in accordance with the present development does not add any additional steps to the assembly process. Including the ground contact G as an integral part of the connector body CB also reduces the number of inventoried parts to be stocked.

The structure of the ground contact G can be seen with reference to FIG. 7A and also FIGS. 3 and 4A. As previously noted, the ground contact G comprises a body GB. The ground contact body GB, itself, comprises: (i) a first portion G1 that is connected to the wall W1 or other portion of the connector body; (ii) a second portion G2 that is connected to and extends transversely from the first portion GB1 at a location spaced from the connector body CB; and (ii) a third portion G3 that is connected to and extends transversely from an outer end the second portion G2. The second portion G2 lies between and interconnects the first and third portions G1,G3. As shown in FIG. 3, at least part of the third portion G3 is located in the recess R of the module housing H of said housing and includes the ground contact face GF that is adapted to engage the DIN rail D or other mounting structure to which the module M is connected. The third portion G3 of the ground contact body is arranged so that it is spaced from and at least partially aligned with the first portion G1 so that a space GS is defined between the first and third portions G1,G3 of said ground contact body GB. When a connector C including the integral ground contact G is installed in the electronics module M, a part of the module housing H is located in but only partially fills the space GS defined between the first and third portions G1,G3 of the ground contact G. The ground contact space GS allows the third portion G3 to be resiliently deflectable toward and away from the first portion G1 as indicated by the arrow DX in FIG. 7A. This resilient movement of the third portion G3 allows the ground contact G to be conformed and dimensioned to ensure that the ground face GF will firmly engage the associated DIN rail D located in the module recess R without being permanently deformed in a manner that would degrade the pressure contact between the ground face GF and the DIN rail flange DF. The ground contact G is manufactured from any suitable metal known in the art of electrical contacts.

Although the invention is described with reference to mounting the module M to a DIN rail D, the module M can alternatively be configured to mount to a panel or other structure, and the ground face GF of the ground contact G would correspondingly be configured to make electrical pressure contact with the panel or other electrically conductive structure to which the module is operatively mounted.

The development has been described with reference to preferred embodiments. Those of ordinary skill in the art will recognize that modifications and alterations to the preferred embodiments are possible. The disclosed preferred embodiments are not intended to limit the scope of the claims, which are to be construed as broadly as legally possible, whether literally or according to the doctrine of equivalents.

The invention claimed is:

1. An electronics module comprising:

a housing comprising an external recess adapted to receive an associated DIN rail mounting structure;

a latch mechanism associated with said external recess and adapted to engage the associated mounting structure;

an electronics circuit board located within said housing;

an electrical connector physically and electrically connected to said electronics circuit board, said electrical connector comprising: (i) a polymeric connector body; (ii) a plurality of electrical contacts secured to said polymeric connector body and comprising contact pins physically and electrically connected to said circuit board and adapted to mate with an associated connector of an adjacent module for transmission of electrical power and data to the associated connector; and (iii) a ground contact secured to said polymeric connector body and comprising a ground pin physically and electrically connected to said circuit board;

said ground contact comprising a ground contact body that extends from said connector body into said recess, said ground contact body comprising a ground contact face located adjacent said recess and adapted to contact the associated mounting structure to complete a ground path, said ground contact body further comprising:

(i) a first portion connected to said polymeric connector body;

(ii) a second portion connected to and extending transversely from said first portion; and (iii) a third portion including said ground contact face, said third portion connected to and extending transversely from said second portion and at least partially aligned with the first portion such that a space is defined between said first and third portions and such that said third portion is resiliently deflectable toward and away from said first portion, and at least part of said third portion is located in said recess of said housing.

2. The electronics module as set forth in claim 1, wherein said ground contact body is insert molded as a part of said polymeric connector body.

3. The electronics module as set forth in claim 1, wherein said ground contact body is secured to said polymeric connector body by mechanical engagement of said ground contact body with a mating structure of said connector body.

4. The electronics module as set forth in claim 3, wherein said polymeric connector body includes a retaining slot, and wherein said ground contact body is located in said slot.

5. The electronics module as set forth in claim 4, wherein said polymeric connector body comprises first and second ground contact retaining tabs that project outwardly from a wall of said connector body, wherein said retaining slot is defined between said first and second ground contact retaining tabs.

6. The electronics module as set forth in claim 1, further comprising a metallic EMI shield that surrounds part of said polymeric connector body and that is electrically connected to said ground contact.

7. An electrical connector comprising:

a polymeric connector body;

a plurality of electrical contacts secured to said connector body and comprising respective contact pins that project outwardly relative to said connector body;

a ground contact secured to said connector body and comprising a ground pin that projects outwardly relative to said connector body;

wherein said polymeric connector body, said plurality of electrical contacts, and said ground contact are connected together as an integral structure and said contact pins and said ground pin are adapted for being soldered to an associated circuit board, said ground contact further comprising:

(i) a first portion connected to said polymeric connector body;

(ii) a second portion connected to and extending transversely from said first portion; and (iii) a third portion including a ground contact face adapted to abut an associated DIN rail, said third portion connected to and extending transversely from said second portion and at least partially aligned with the first portion such that a space is defined between said first and third portions and such that said third portion is resiliently deflectable toward and away from said first portion.

8. The electrical connector as set forth in claim 7, wherein said connector body comprises a molded polymeric structure into which said ground contact body is insert molded.

9. The electrical connector as set forth in claim 7, wherein said ground contact body is secured to said connector body by mechanical engagement of said ground contact body with a mating structure of said connector body.

10. The electrical connector as set forth in claim 9, wherein said connector body comprises a molded polymeric structure that includes a retaining slot, and wherein said ground contact body is located in said slot.

11. The electrical connector as set forth in claim 10, wherein said connector body comprises first and second ground contact retaining tabs that project outwardly from a wall of said connector body, and wherein said retaining slot is defined between said first and second retaining tabs.

12. The electrical connector as set forth in claim 11, wherein said ground contact body is frictionally secured in said retaining slot.

13. A method for installing a ground connector on a circuit board, said method comprising:

providing an electrical connector comprising:

a polymeric connector body;

a plurality of power and data electrical contacts secured to said connector body and comprising a plurality of contact pins that project from said connector body;

a ground contact integrally secured to said connector body and comprising a ground pin that projects from said connector body, said ground contact further comprising: (i) a first portion connected to said polymeric connector body; (ii) a second portion connected to and extending transversely from said first portion; and (iii) a third portion including a ground contact face, said third portion connected to and extending transversely from said second portion and at least partially aligned with the first portion such that a space is defined between said first and third portions and such that said third portion is resiliently deflectable toward and away from said first portion;

placing said connector body in contact with a circuit board by simultaneously moving said connector body, said plurality of electrical contacts and said ground contact as an integral unit toward and into contact with said circuit board such that said plurality of contact pins and said ground pin are located adjacent said circuit board;

soldering said contact pins and said ground pin to respective electrically conductive locations on said circuit board.

14. The method for installing a ground connector on a circuit board as set forth in claim 13, wherein said step of providing said electrical connector comprises:

providing said polymeric connector body including a plurality of contact locations adapted for receiving said power and data electrical contacts and a retaining slot adapted for receiving said ground contact;

installing said plurality of power and data electrical contacts in said respective plurality of contact locations;

installing said ground contact in said retaining slot, such that said electrical connector comprises said polymeric connector body, said plurality of electrical contacts, and said ground contact all connected together as an integral structure.

15. The method for installing a ground connector on a circuit board as set forth in claim 14, wherein said step of providing an electrical connector further comprises installing a metallic EMI shroud around said connector body such that said ground contact is electrically connected to said EMI shroud.

* * * * *